US008191882B2

(12) United States Patent
Kikkawa et al.

(10) Patent No.: US 8,191,882 B2
(45) Date of Patent: Jun. 5, 2012

(54) SPINE FORMATION DEVICE, POST-PROCESSING APPARATUS, AND SPINE FORMATION SYSTEM

(75) Inventors: Naohiro Kikkawa, Kawasaki (JP); Shinji Asami, Machida (JP); Nobuyoshi Suzuki, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 148 days.

(21) Appl. No.: 12/662,216

(22) Filed: Apr. 6, 2010

(65) Prior Publication Data

US 2010/0258994 A1 Oct. 14, 2010

(30) Foreign Application Priority Data

Apr. 13, 2009 (JP) ..... 2009-097199
Feb. 3, 2010 (JP) ..... 2010-022274

(51) Int. Cl.
*B31F 1/00* (2006.01)
*B65H 37/04* (2006.01)

(52) U.S. Cl. ..... 270/45; 270/32; 270/37; 270/59; 270/58.07

(58) Field of Classification Search ..... 270/32, 270/37, 45, 46, 59, 58.07; 412/22, 23
See application file for complete search history.

(56) References Cited

U.S. PATENT DOCUMENTS 3,451,082 A * 6/1969 Sarring ..... 412/5
6,692,208 B1 * 2/2004 Watkiss et al. ..... 412/1
7,147,598 B2 * 12/2006 Fujimoto et al. ..... 493/405
7,416,177 B2 8/2008 Suzuki et al.
7,431,273 B2 * 10/2008 Kamiya et al. ..... 270/37
2006/0055100 A1 3/2006 Suzuki et al.
2008/0106023 A1 * 5/2008 Kaneko et al. ..... 270/18
2008/0179809 A1 7/2008 Kikkawa et al.
2008/0284092 A1 11/2008 Suzuki et al.
2009/0039593 A1 2/2009 Kikkawa et al.
2009/0057977 A1 * 3/2009 Kawaguchi ..... 270/37
2009/0152789 A1 6/2009 Kikkawa et al.
2009/0258774 A1 10/2009 Suzuki et al.

FOREIGN PATENT DOCUMENTS

JP 2001-260564 9/2001
JP 2007-237562 9/2007

* cited by examiner

*Primary Examiner* — Leslie A Nicholson, III
(74) *Attorney, Agent, or Firm* — Harness, Dickey & Pierce, P.L.C.

(57) ABSTRACT

A spine formation device includes a sheet conveyer to transport a bundle of folded sheets, a pressing unit including a first pressing member movable according to a pressing load in a pressing direction perpendicular to the sheet conveyance direction to press opposed sides of the front end portion of the folded sheets and a second pressing member attached to the first pressing member, to press the front end portion of the folded sheets, and a spine formation member disposed at a predetermined distance from the pressing unit. The second moves in the sheet conveyance direction in conjunction with the first pressing member moving in the pressing direction and presses the folded portion of the bundle of sheets with a predetermined spine-forming load against a contact surface of the spine formation member, thereby forming a spine of the bundle of sheets.

18 Claims, 14 Drawing Sheets

SPINE FORMATION DEVICE, POST-PROCESSING APPARATUS, AND SPINE FORMATION SYSTEM

CROSS-REFERENCE TO RELATED APPLICATIONS

This patent specification is based on and claims priority from Japanese Patent Application Nos. 2009-097199, filed on Apr. 13, 2009, and 2010-022274, filed on Feb. 3, 2010 in the Japan Patent Office, the contents of which are hereby incorporated by reference herein in their entirety.

BACKGROUND OF THE INVENTION

1. Field of the Invention

The present invention generally relates to a spine formation device to form a spine of a bundle of folded sheets, a post-processing apparatus including the spine formation device, and a spine formation system including the spine formation device, and an image forming apparatus, such as a copier, a printer, a facsimile machine, or a multifunction machine capable of at least two of these functions, that includes any of those devices.

2. Discussion of the Background Art

Post-processing apparatuses that fold and/or bind together a bundle of sheets of recording media (hereinafter "booklet") are widely used.

When the spine of the booklet is flattened, bulging of the booklet can be reduced, and accordingly multiple booklets can be piled together. This reformation is important for ease of storage and transport because it is difficult to stack booklets if their spines bulge, making it difficult to store or carry them. For example, the bulging spine of the booklet can be flattened using a pressing member configured to sandwich an end portion of the booklet adjacent to the spine and a spine-forming roller configured to rotate along the spine of the booklet in a longitudinal direction of the spine while contacting the spine of the booklet. The spine-forming roller moves at least once over the entire length of the spine of the booklet fixed by the pressing member while applying a pressure sufficient for flatten the spine to it. Additionally, an amount by which the spine of the booklet projects from the pressing member can be set by a stop plate disposed facing the spine of the booklet, configured to move toward and away from the spine of the booklet.

However, in this configuration, although the spine-forming roller contacts the spine of the booklet linearly or in a small contact area while moving and applying pressure to the spine of the booklet to flatten it, the pressure necessary to flatten the spine tends to change constantly and significantly. The change in the pressure to flatten the spine causes a relative distance between the spine-forming roller and the spine of the booklet to fluctuate constantly. As a result, the spine can be wavy in the longitudinal direction of the spine even though the spine is straightened in the direction of the thickness of the booklet.

Additionally, although the stop plate sets an amount by which the booklet projects from the pressing member, that is, sets the position of the booklet, the stop plate does not contribute to flattening the spine.

In view of the foregoing, the inventor of the present invention recognizes that there is a need to form the spine of the booklet with a higher degree of flatness, which known approaches fail to do.

SUMMARY OF THE INVENTION

In view of the foregoing, in one illustrative embodiment of the present invention provides a spine formation device to flatten a spine of a bundle of folded sheets. The spine formation device includes a sheet conveyer that conveys the bundle of folded sheets with a folded portion of the bundle of folded sheets forming a front end portion of the bundle of folded sheets, a pressing unit disposed downstream from the sheet conveyer in a sheet conveyance direction in which the sheet conveyer conveys the bundle of folded sheets, and a spine formation member disposed downstream from the pressing unit in the sheet conveyance direction at a predetermined distance from the pressing unit. The pressing unit includes a first pressing member movable according to a pressing load applied thereto in a pressing direction perpendicular to the sheet conveyance direction to press opposed sides of the front end portion of the bundle of folded sheets conveyed with the sheet conveyer, and a second pressing member attached to the first pressing member and disposed on the side closer to the bundle than the first pressing member, to press the front end portion of the bundle of folded sheets. The second pressing member is movable in the sheet conveyance direction in conjunction with movement of the first pressing member.

In conjunction with the first pressing member moving in the pressing direction, the second pressing member presses the folded portion of the bundle of folded sheets against a contact surface of the spine formation member with a predetermined spine-forming load, thereby forming a spine of the bundle of sheets.

In another illustrative embodiment of the present invention, a post-processing apparatus includes a saddle-stapler to staple a bundle of sheets together along a centerline, a folding unit to fold the bundle of sheets, and the spine formation device described above.

Yet in another illustrative embodiment of the present embodiment, a spine formation system includes an image forming apparatus, a post-processing apparatus to perform post processing of sheets transported from the image forming apparatus, and the spine formation device described above.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
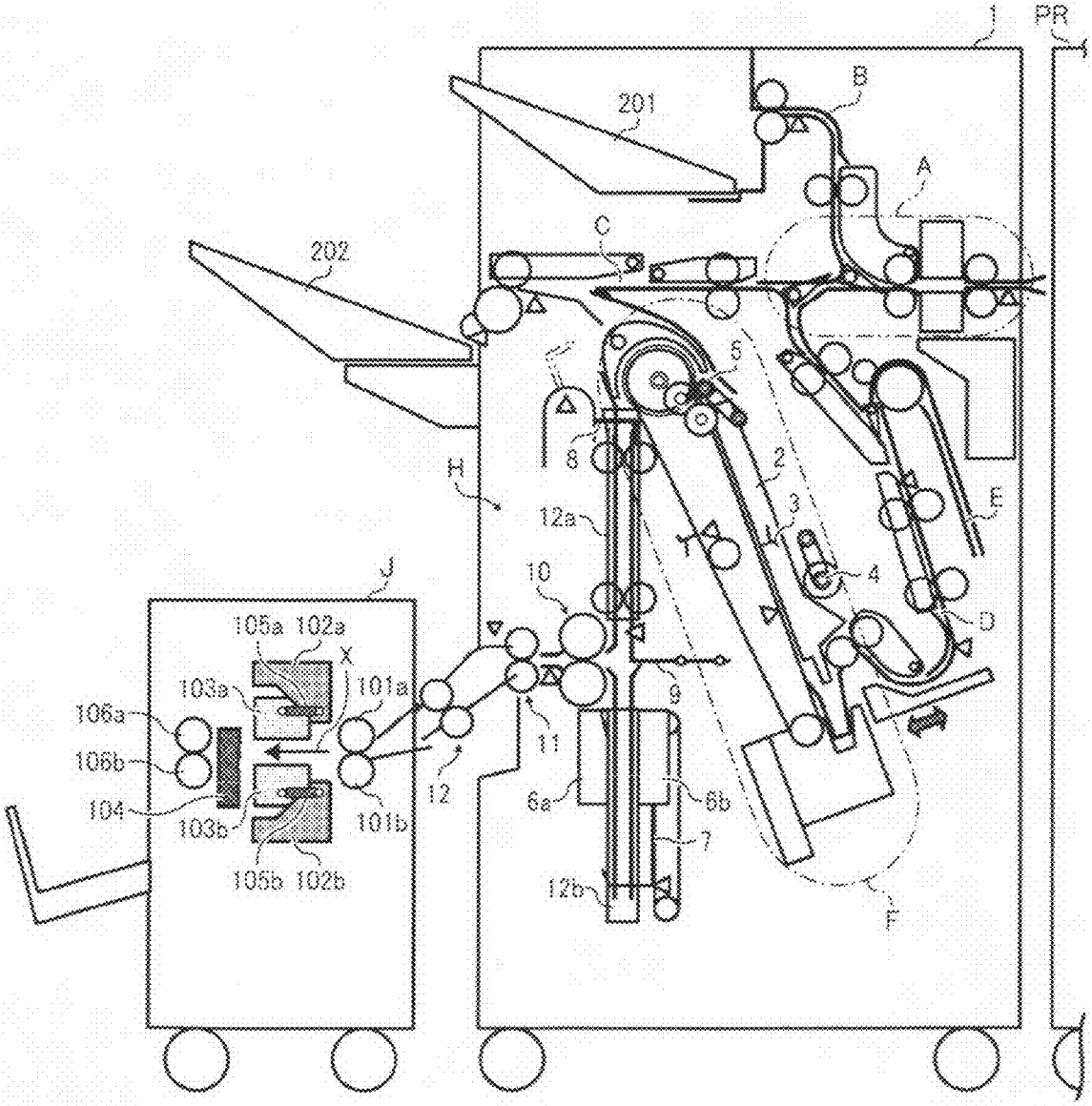
FIG. 1 illustrates a spine formation system including a post-processing apparatus and a spine formation device according to an illustrative embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a spine formation system according to an illustrative embodiment of the present invention is described.

FIG. 1 illustrates the spine formation system that includes a post-processing apparatus 1 and a spine formation device (hereinafter "square-spine device") J to flatten or straighten spines of books.

The post-processing apparatus 1 includes an entrance path A along which sheets of recording media transported form an image forming apparatus PR to the post-processing apparatus 1 are initially transported, a transport path B leading from the entrance path A to a proof tray 201, a shift tray path C leading from the entrance path A to a shift tray 202, a transport path D leading from the entrance path A to a first processing tray F, a storage area E disposed along the transport path D, and a second processing tray H disposed downstream from the first processing tray F in a direction in which the sheet is transported (sheet conveyance direction). The square-spine device J is connected a downstream side of the post-processing apparatus 1 in the sheet conveyance direction. The first processing tray F aligns multiple sheets and staples an edge portion of the aligned multiple sheets as required. The multiple sheets processed on the first processing tray F are stored in the storage area E and then transported to the first processing tray F at a time. The sheets transported along the entrance path A or discharged from the first processing tray F are transported along the shift tray path C to the shift tray 202. In the present embodiment, the second processing tray H performs center-folding and/or saddle-stapling (or saddle-stitching) of the multiple sheets aligned on the first processing tray F. Saddle-stapling means stapling sheets along a centerline. Then, the square-spine device J flattens a folded edge (spine) of the multiple sheets. It is to be noted that the post-processing apparatus 1 has a known configuration and performs known operations, which are briefly described below.

The post-processing apparatus 1 can perform various types of post-processing, such as, aligning, sorting, stapling, punching, and folding of the sheets.

The sheets transported to the post-processing apparatus 1 to be stapled along its centerline are stacked on the first processing tray F sequentially. A jogger fence 2 aligns the sheets placed on the first processing tray F in a width direction or transverse direction, which is perpendicular to the sheet conveyance direction. Further, a roller 4 pushes the sheets so that a trailing edge of the sheet contacts a back fence, not shown, disposed an upstream side in the sheet conveyance direction while a release belt, not shown, rotates in reverse so that a leading edge of the sheets is pressed by a back of a release pawl 3 disposed on a down stream side in the sheet conveyance direction, and thus a bundle of sheets are aligned in the sheet conveyance direction. After the sheets are aligned in the sheet conveyance direction as well as in the width direction, the release pawl 3 and a pressure roller 5 turn the bundle of sheets a relatively large angle along a guide roller, not shown, to the second processing tray H.

Then, the booklet is transported to a reference fence 7 on the second processing tray H, and a center stapling fences 12*a* and 12*b* align the sheets in the width direction. Further, the trailing edge of the bundle of sheets is pushed to an aligning pawl 8, and thus the sheets are aligned in the sheet conveyance direction. After the alignment, center staplers 6*a* and 6*b* staple the sheets along its centerline.

Then, the reference fence 7 pushes a center portion (folded position) of the sheets to a position facing a folding plate 9. The folding plate 9 moves horizontally in FIG. 1, which is perpendicular to the sheet conveyance direction, and a leading edge portion of the folding plate 9 pushes the folded position of the bundle of sheets between a pair of folding rollers 10, thereby folding the sheets. Then, a pair of discharge rollers 11 and a pair of intermediate rollers 12 forward the folded sheets to the square-spine device J. Thus, the reference fence 7, the folding plate 9, and the folding rollers 10 together form a folding unit.

The square-spine device J includes a pair of transport rollers 101*a* and 101*b* serving as a sheet conveyer, a pair of first pressing members 102*a* and 102*b*, a pair of second pressing members 103*a* and 103*b*, a pair of pulling springs 105*a* and 105*b*, a fence 104 disposed facing downstream edges of the second pressing members 103*a* and 103*b* in a direction indicated by arrow X shown in FIG. 1, in which the sheets are transported in the square-spine device J (sheet conveyance direction X), a pair of discharge rollers 106*a* and 106*b* disposed downstream from the fence 104 in the sheet conveyance direction. The first pressing members 102*a* and 102*b* and the second pressing members 103*a* and 103*b* together form a pressing unit, and the fence 104 serves as a spine formation member. The second pressing members 103*a* and 103*b* respectively serve as a first part and a second part. Generally, the fence 104 can be rectangular like a block, for example. However, the shape of the fence 104 is not limited thereto as long as it has a flat portion on the side facing the bundle of sheets against which the spine of the bundle is pressed.

These components are disposed along the sheet conveyance direction X. The pulling springs 105*a* and 105*b* serve as elastic bias applicator to bias the first pressing members 102*a* and 102*b* as well as the second pressing members 103*a* and 103*b* toward each other. It is to be noted that a driving mechanism for the respective parts are omitted in FIG. 1.

Figure 2A:
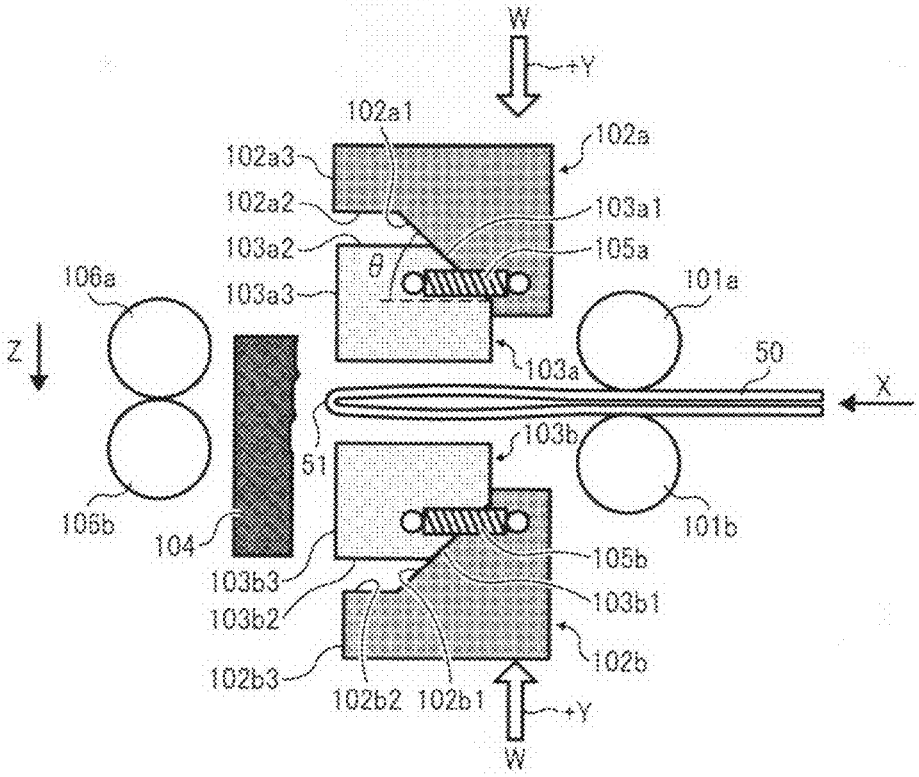
FIG. 2A illustrates a state of the spine formation device at the start of spine forming operation.
Figure 2B:
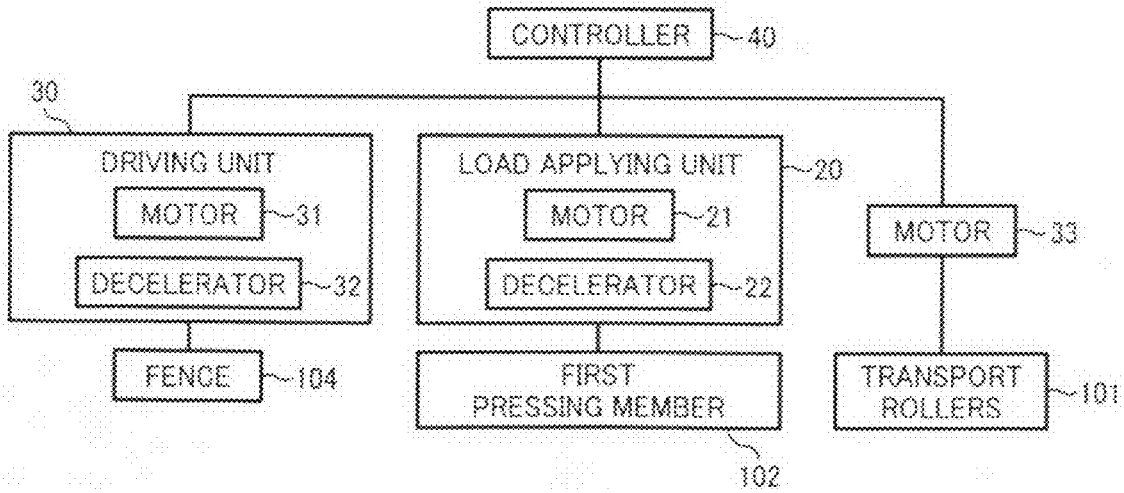
FIG. 2B is a control block diagram of the spine formation device.

FIG. 2A illustrates a state of the square-spine device J at the start of spine forming operation. FIG. 2B is a control block diagram of the square-spine device J. It is to be noted that, reference number 50 shown in FIG. 2A represents a bundle of sheets (hereinafter also "booklet 50") processed by the square-spine device J, and hereinafter subscripts "a" and "b" attached to the end of identical reference numeral representing the components of the square-spine device J may be omitted when discrimination therebetween is not necessary.

As shown in FIG. 2A, the first pressing members 102*a* and 102*b* respectively include oblique contact surfaces 102*a*1 and 102*b*1 oblique to the sheet conveyance direction X and parallel surfaces 102*a*2 and 102*b*2 in parallel to the sheet conveyance direction X. Similarly, the second pressing members 103*a* and 103*b* respectively include oblique contact surfaces 103*a*1 and 103*b*1 oblique to the sheet conveyance direction X and parallel surfaces 103*a*2 and 103*b*2 in parallel to the sheet conveyance direction X. The oblique contact surfaces 102*a*1 and 102*b*1 of the first pressing members 102*a* and 102*a* respectively slidingly contact the oblique contact surfaces 103*a*1 and 103*b*1 of the second pressing members 103*a* and 103*b*.The oblique contact surfaces 102*a*1, 102*b*1, 103*a*1, and 103*b*2 of the first and second pressing members 102*a*, 102*b*, 103*a*, and 103*b* form an angle (inclination) θ that is smaller than 45 degrees with the sheet conveyance direction X, and the inclination θ is set so that, when a load W is applied to the first pressing members 102*a* and 102*b* in the direction indicated by respective arrows +Y shown in FIG. 2A, in which the first pressing members 102*a* and 102*b* approach each other (hereinafter "pressing direction+Y") to press opposed sides of the front end portion of the booklet 50, a component of force in parallel to the sheet conveyance direction (component of force Fh) is smaller than a component of force in a direction perpendicular to the sheet conveyance direction X (component of force Fp).

With this configuration, when the load W in the pressing direction +Y is applied to the first pressing members 102, the second pressing members 103 slide in the sheet conveyance direction X, in which the booklet 50 is transported, against the elastic bias force exerted by the respective pulling springs 105. The second pressing members 103*a* and 103*b* can move until the parallel surfaces 103*a*2 and 103*b*2 of the second pressing members 103*a* and 103*b* contact the parallel surfaces 102*a*2 and 102*b*2 of the first pressing members 102*a* and 102*b*, respectively, and the distance by which the second pressing members 103*a* and 103*b* move in that direction depends on the size of the load W. In other words, the size of the load W determines a projection amount of the second pressing members 103*a* and 103*b*, which is a distance by which leading edge faces 103*a*3 and 103*b*3 of the second pressing members 103*a* and 103*b* project from leading edge faces 102*a*3 and 102*b*3 of the first pressing members 102*a* and 102*b*, respectively.

It is to be noted that a maximum projection amount of the second pressing members 103*a* and 103*b* is the difference in the length in the sheet conveyance direction X between the parallel surfaces 102*a*2 and 102*b*2 of the first pressing member 102*a* and 102*b* and the parallel surfaces 103*a*2 and 103*b*2 of the second pressing members 103*a* and 103*b*.With this configuration, until the second pressing members 103 project in the sheet conveyance direction X as far as possible, the load W is applied to the booklet 50 via the first pressing members 102, and the booklet 50 is held by the component of force Fp of the load W. A load applying unit 20 including a motor 21 and a decelerator 22 applies the load W to the first pressing members 102. Alternatively, a hydraulic mechanism or a pneumatic mechanism may be used as the load applying unit 20. It is to be noted that the force to hold the booklet 50 is expressed as W cos θ, wherein W and θ respectively represent the size of the load and the inclination of the contact surfaces 102*a*, 102*b*1, 103*a*1, and 103*b*1 to the sheet conveyance direction X.

The fence 104 is movable in the direction perpendicular to the sheet conveyance direction X, driven by a driving unit 30. Although the fence 104 is movable vertically in FIG. 2A in the present embodiment, the fence 104 may move in a direction perpendicular to the surface of paper on which FIG. 2A is drawn.

The fence 104 moves upward from beneath the booklet 50 across the sheet transport path in FIG. 2A, shapes a leading edge portion (folded portion) 51 of the booklet 50 into square, and then moves downward as indicated by arrow Z in FIG. 2A. The driving unit 30 includes a motor 31 as a driving source, and the driving force generated by the motor 31 is transmitted via a decelerator 32 to the fence 104.

In FIG. 2B, reference number 33 represents a motor serving as a driving source of the transport rollers 101, and 40 represents a controller of the square-spine device J.

FIGS. 3 through 7 illustrate movement of the square-spine device J configured as described above.

Figure 3:
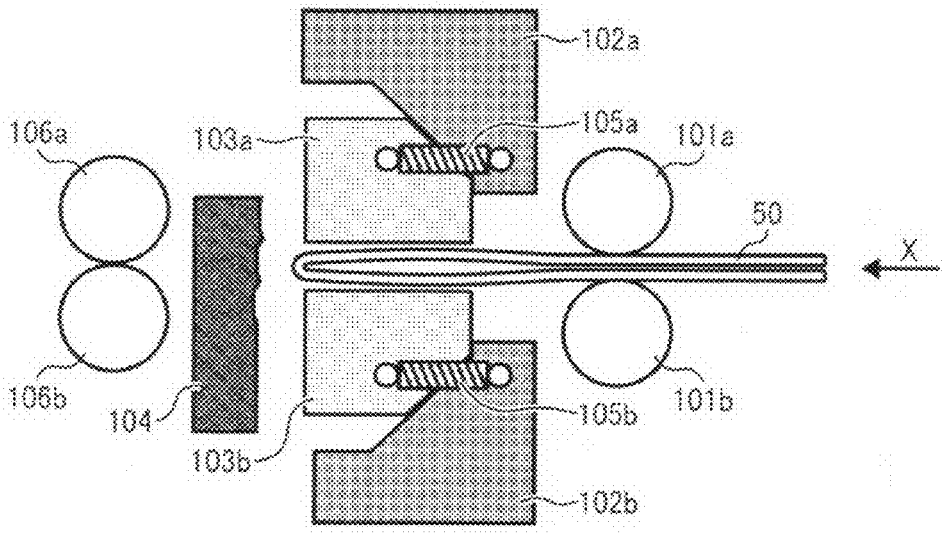
FIG. 3 illustrates the spine formation device in which a pair of first pressing members approach each other, causing a pair of second pressing members to sandwich a bundle of sheets therebetween.
Figure 4:
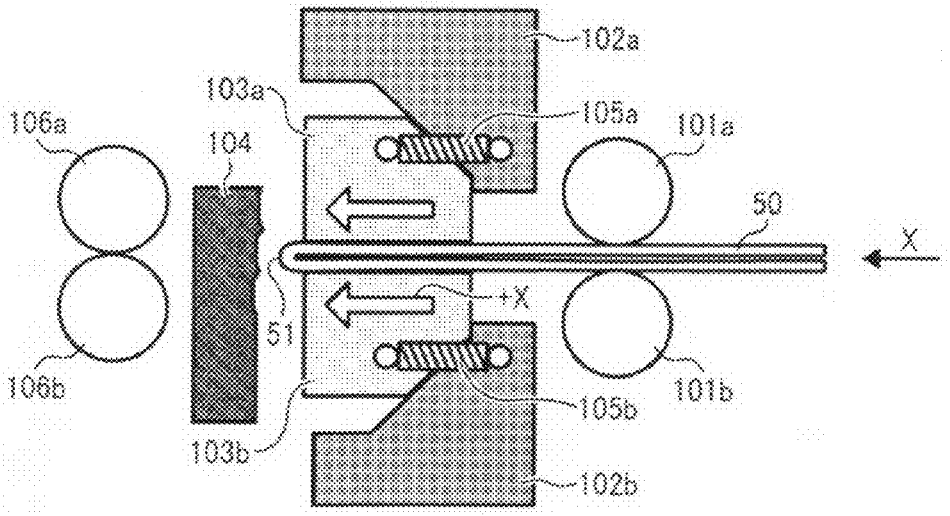
FIG. 4 illustrates the spine formation device transporting the bundle of sheets sandwiched by the second pressing members toward a fence.

The booklet 50 stapled or folded along its centerline is transported in the sheet conveyance direction X by the transport rollers 101 that can be at a given or predetermined distance from each other as shown in FIG. 3 to reduce the pressure therebetween, and then the booklet 50 is stopped when its leading edge portion 51 projects from the leading edge faces 103*a*3 and 103*b*3 of the second pressing members 103*a* and 103*b*. Then, the first pressing members 102 move in the respective pressing direction +Y shown in FIG. 3. Accordingly, as shown in FIG. 3, the second pressing members 103 move in the respective pressing directions +Y and approach each other while biased by the respective pulling springs 105 to the upstream side in the sheet conveyance direction X. At this time, the second pressing members 103 is on standby and is kept by the respective pulling springs 105 at an extreme upstream position in the sheet conveyance direction X, in which the second pressing members 103 moves toward and away from the first pressing members 102, until they contact the booklet 50.

After the second pressing members 103 have reached a position to hold the booklet 50 with a certain degree of pressure, the second pressing members 103 can move no more in the pressing direction +Y. Then, the second pressing members 103 move in the sheet conveyance direction as indicated by arrows +X respectively along the contact surfaces 102*a*1 and 102*b*1 of the first pressing members 102*a* and 102*b*, against the elastic bias force exerted by the pulling springs 105. At this time, the transport rollers 101 run idle because the transport rollers 101 have a one-way mechanism, and the booklet 50 is transported further in the direction indicated by arrows +X by the second pressing members 103.

Figure 5:
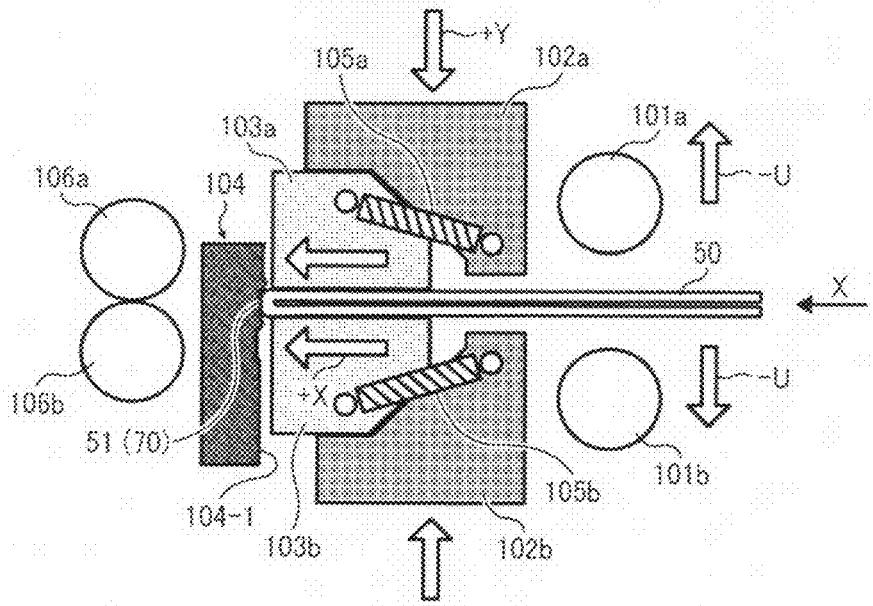
FIG. 5 illustrates the spine formation device pressing a folded portion of the sheets sandwiched by the second pressing members against the fence, thereby forming a spine of the sheets.

Then, the leading edge portion 51 of the booklet 50 contacts a surface (contact surface) 104-1 of the fence 104 as shown in FIG. 5. Thus, the leading edge portion 51 of the booklet 50 is pressed against the contact surface 104-1 of the fence 104 with a predetermined or given load that in the present embodiment is a load W sin θ and is flattened. As a result, the leading edge portion 51 of the booklet 50 becomes a flat spine 70. After the spine 70 is thus formed, the transport rollers 101*a* and 101*b* move in directions indicated by respective arrows −U, releasing the pressure to transport the booklet 50 (hereinafter "transport pressure").

Figure 6:
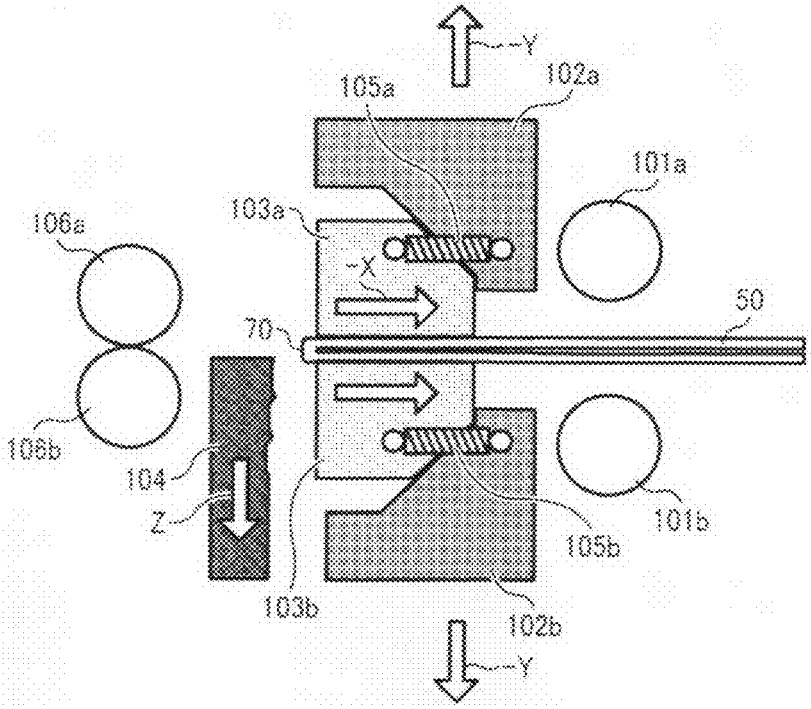
FIG. 6 illustrates the spine formation device in which the fence moves away from the sheets after the spine of the sheets is formed.

Subsequently, as shown in FIG. 6, the first pressing members 102 move away from each other, in directions indicated by respective arrows −Y, after which the fence 104 moves in the direction indicated by arrow Z in FIG. 6. Accordingly, the second pressing members 103 are moved from the positions shown in FIG. 5 to the positions shown in FIG. 6 in directions indicated by respective arrows −X shown in FIG. 6 by the respective pulling springs 105, thereby transporting the booklet 50 in the direction indicated by arrow −X. After the movement of second pressing members 103 in the directions indicated by respective arrows −X is prohibited, that is, right end portions of the second pressing members 103 in FIG. 6 contact right end portions of the first pressing members 102 in FIG. 6, the second pressing members 103 move away from the booklet 50 in the directions indicated by respective arrows -Y together with the first pressing members 102. Thus, the pressure applied to the booklet 50 from both sides is released as shown in FIG. 7.

Figure 7:
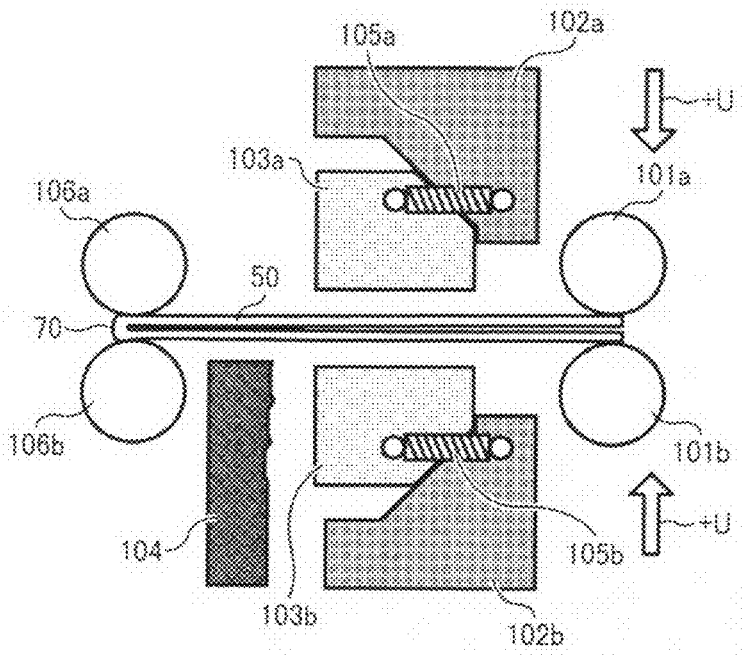
FIG. 7 illustrates the spine formation device discharging the sheets after the spine of the sheets is formed.

In conjunction with the above-described releasing operation, the transport rollers 101 move in directions indicated by respective arrows +U shown in FIG. 7 and give the booklet 50 a force to transport it toward the discharge rollers 106 as shown in FIG. 7. Then, the discharge rollers 106*a* and 106*b* discharge the booklet 50 outside the square-spine device J. The operations described above with reference to FIG. 2A through 7 are basic operations in the present embodiment.

As described above, the contact surfaces 103*a*1 and 103*b*1 of the second pressing members 103*a* and 103*b* respectively contact the contact surfaces 102*a*1 and 102*b*1 of the first pressing members 102*a* and 102*b*.When a force acting on the second pressing members 103*a* and 103*b* is greater than the electrostatic frictional force therebetween, the contact surfaces 103*a*1 and 103*b*1 can slide on the contact surfaces 102*b*1 and 102*b*1, that is, the second pressing members 103*a* and 103*b* can move in the direction indicated by arrow +X or −X against the movement of the first pressing members 102*a* and 102*b* in the direction indicated by arrow +Y or −Y. At that time, the position of the leading edge surfaces 103*a*3 and 103*b*3 of the second pressing members 103*a* and 103*b* changes according to the position (sliding position) of the contact surfaces 103*a*1 and the 103*b*1 relative to the first pressing members 102*a* and 102*b*. Additionally, the fence 104 is movable back and forth in the sheet conveyance direction X in addition to the direction indicated by arrow Z shown in FIG. 6, perpendicular to the sheet conveyance direction X. Therefore, the fence 104 can press against the leading edge portion 51 of the booklet 50 even when the position of the leading edge surfaces 103*a*3 and 103*b*3 is changed in the sheet conveyance direction X. This enables the fence 104 to accommodate various different thicknesses of booklets.

Figure 8:
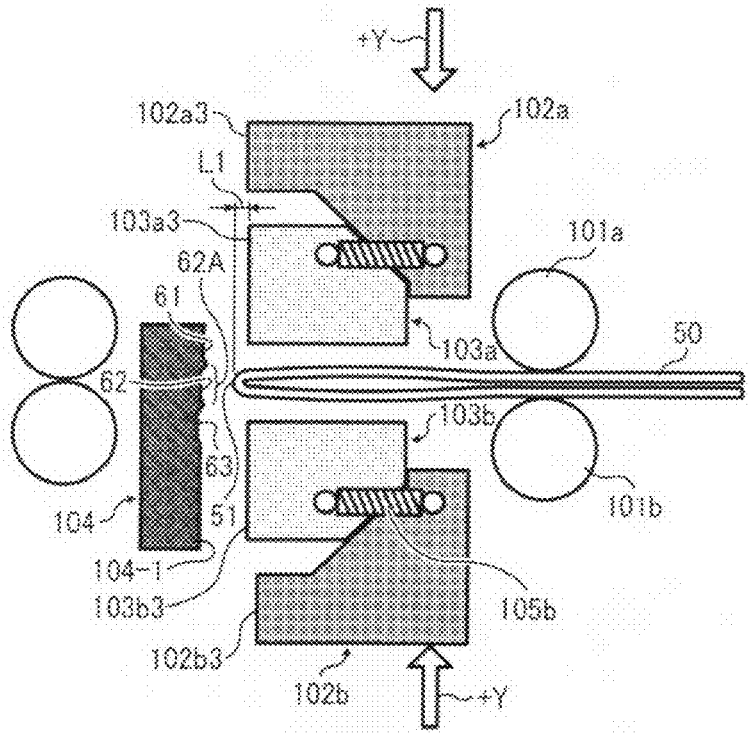
FIG. 8 illustrates a state of the spine formation device at the start of spine forming operation using a second spine-forming face.

In the present embodiment, the spine 70 of the booklet 50 can be formed in accordance with the thickness of booklet 50 or the number of sheets bundled together. More specifically, as shown in FIG. 8, the contact surface 104-1 of the fence 104 facing the leading edge portion 51 of the booklet 50 includes first, second, and third spine-forming faces 61, 62, and 63 corresponding to multiple different thicknesses of booklets 50. Each of the first, second, and spine-forming faces 61, 62, and 63 may be a recess having a flat face of a predetermined width to flatten the spine of the booklet 50. The widths of the first, second, and third spine-forming faces 61, 62, and 63 are lengths in the direction of thickness of the booklet 50.

Simultaneously, the projection amount of the second pressing members 103*a* and 103*b*, that is, the length of the leading edge portion 51 of the booklet 50 projecting from the leading edge faces 102*a*3 and 102*b*3 of the first pressing members 102*a* and 102*b* is varied corresponding to the first, second, and third spine-forming faces 61, 62, and 63.

Figure 9:
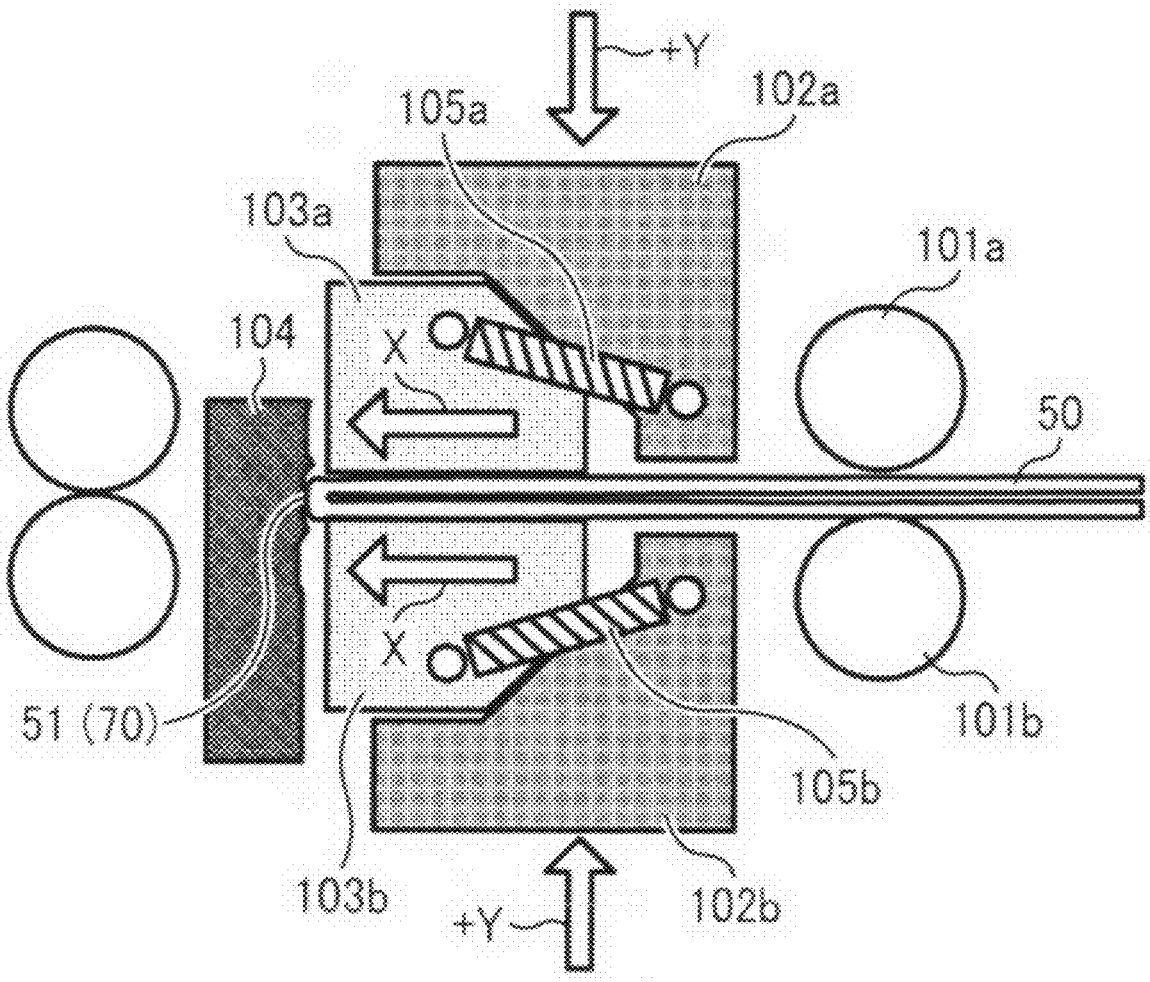
FIG. 9 illustrates a state in which the spine of the sheets is being formed by the second spine-forming face.
Figure 10:
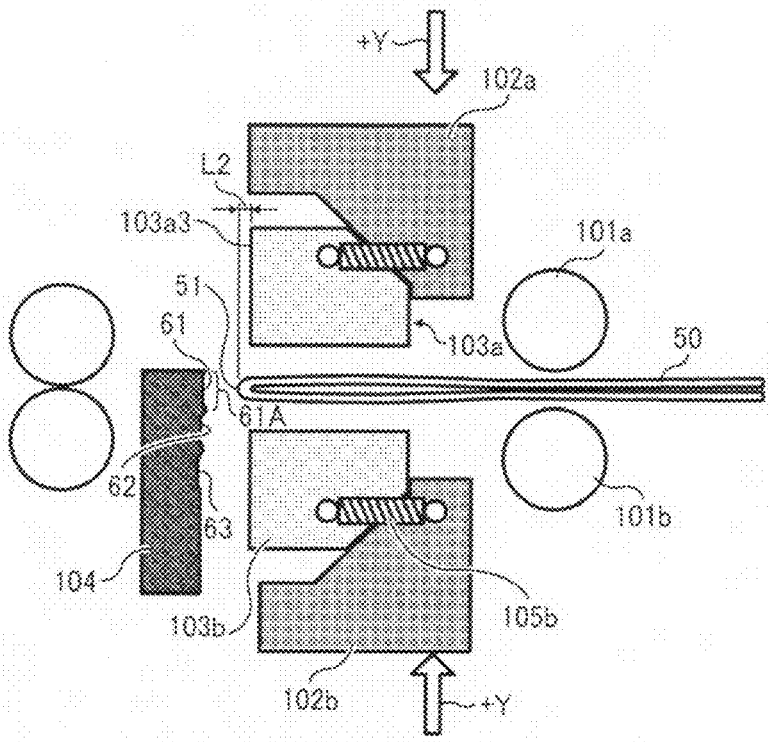
FIG. 10 illustrates a state of the spine formation device at the start of spine forming operation using a first spine-forming face.
Figure 11:
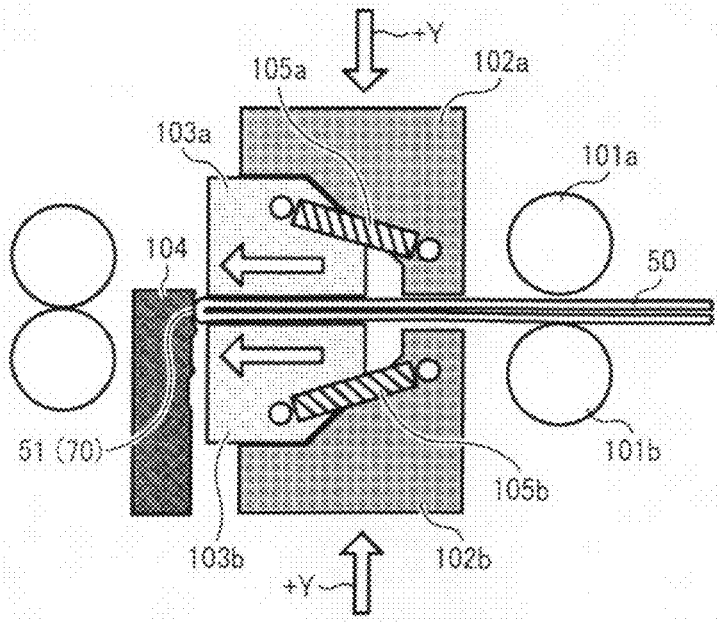
FIG. 11 illustrates a state in which the spine of the sheets is being formed by the first spine-forming face.
Figure 12:
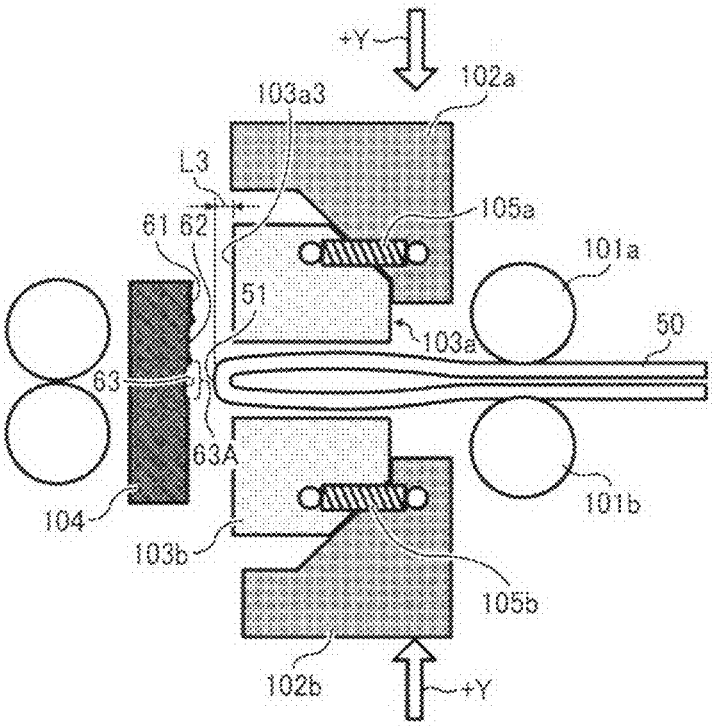
FIG. 12 illustrates a state of the spine formation device at the start of spine forming operation using a third spine-forming face.
Figure 13:
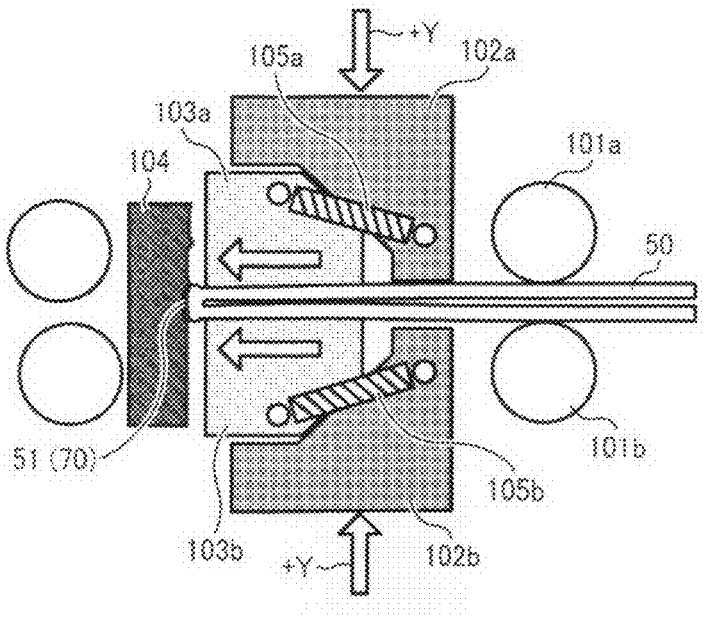
FIG. 13 illustrates a state in which the spine of the sheets is being formed by the third spine-forming face.

FIGS. 8 and 9 illustrate forming the spine of the booklet 50 using the second spine-forming face 62. FIGS. 10 and 11 illustrate forming the spine of the booklet 50 using the first spine-forming face 61. FIGS. 12 and 13 illustrate forming the spine of the booklet 50 using the third spine-forming face 63.

Referring to FIG. 8, the lengths of the first, second, and third spine-forming faces 61, 62, and 63 formed on the contact surface 104-1 are different in a direction of thickness of the booklet 50 (widths), perpendicular to the sheet conveyance direction X, as well as in the sheet conveyance direction X (depths). The second spine-forming face 61 is larger than the first spine-forming face 62, and the third spine-forming face 63 is larger than the second spine-forming face 61 (61<62<63) in the configuration shown in FIG. 8.

Accordingly, when L1, L2, and L3 represent first, second, and third projection amounts of the leading edge portion 51 from the leading edge faces 103*a*3 and 103*b*3 of the second pressing members 103*a* and 103*b* shown in FIG. 8, that shown in FIG. 10, and that shown in FIG. 12, respectively, L2<L1<L3 is satisfied.

Optimum relations between the shape, that is, the depths and widths, of the first, second, and third spine-forming faces 61, 62, and 63 and the first, second, and third projection amounts L1, L2, and L3, by which the leading edge portion 51 projects from the leading edge faces 103*a*3 and 103*b*3 of the second pressing members 103*a* and 103*b*, can be determined experimentally before shipment, and the optimum relations can be stored in an erasable programmable read-only memory (EPROM) used by the controller 40 shown in FIG. 2B that can be formed with a central processing unit (CPU). Based on the thickness of the booklet 50 or the number of sheets to be bound together, the controller 40 (CPU) refers to the EPROM, selects a suitable one of the first, second, and third spine-forming faces 61, 62, and 63, and sets the projection amount of the fence 104 to a suitable one of the first, second, and third projection amounts L1, L2, and L3. Then, the controller 40 transmits the projection amount of the fence 104 to the driving unit 30 shown in FIG. 2B of the fence 104 and causes a suitable one of the first, second, and third spine-forming faces 61, 62, and 63 to contact the leading edge portion 51 of the booklet 50.

Next, spine formation of booklets for each different thickness is described below.

(Case 1: Spine formation of booklets with medium thickness consisting of 6 to 15 sheets)

In case 1, the booklet 50 consists of 6 to 15 standard sheets and the spine 70 of the booklet is formed (straightened) by the second spine-forming face 62 with the projection amount L1. More specifically, referring to FIGS. 2B and 8, the controller 40 adjusts the rotational amount of the transport rollers 101 so that the booklet 50 is transported to the position where the leading edge portion 51 projects by the projection amount L1 from the leading edge faces 103*a*3 and 103*b*3 of the second pressing members 103*a* and 103*b*. To adjust the rotational amount of the transport rollers 101, the controller 40 (CPU) causes a driving control circuit, not shown, to adjust the rotational amount of the motor 33, the driving source of the transport rollers 101. From this state, as described above with reference to FIGS. 2A and 4, the load W is applied to the first pressing members 102, moving them in the respective pressing directions Y+, which causes the second pressing members 103 to slide in the sheet conveyance direction X. Then, as shown in FIG. 9, the leading edge portion 51 of the booklet 50 is pressed against the second spine-forming face 62. Then, the leading edge portion 51 is shaped into a spine 70 having flat face whose width, which is the length in the thickness of the booklet 50, is set by a groove 62A including the second spine-forming face 62. Subsequently, as shown in FIG. 5, the transport pressure exerted by the transport rollers 101 is released, and then the booklet 50 is discharged as shown in FIGS. 6 and 7.

(Case 2: Spine formation of thinner booklets consisting of 1 to 5 sheets)

In case 2, the booklet 50 consists of 1 to 5 standard sheets, and the spine 70 of the booklet 50 is formed by the first spine-forming face 61 with the projection amount L2. More specifically, referring to FIGS. 2A and 10, the controller 40 adjusts the rotational amount of the transport rollers 101 so that the booklet 50 is transported to the position where the leading edge portion 51 projects by the projection amount L2 from the leading edge faces 103*a*3 and 103*b*3 of the second pressing members 103*a* and 103*b*. From this state, as described above with reference to FIGS. 2A and 4, the load W is applied to the first pressing members 102, moving them in the respective pressing directions Y+, which causes the second pressing members 103 to slide in the sheet conveyance direction X. Then, as shown in FIG. 11, the leading edge portion 51 of the booklet 50 is pressed against the first spine-forming face 61. Then, the leading edge portion 51 is shaped into a spine 70 having a flat face whose width is set by a groove 61A including the first spine-forming face 61. Subsequently, as shown in FIG. 5, the transport pressure exerted by the transport rollers 101 is released, and then the booklet 50 is discharged as shown in FIGS. 6 and 7.

It is to be noted that the first spine-forming face 61 is positioned and the projection amount of the booklet 50 is adjusted directed by the CPU similarly to the descriptions above.

(Case 3: Spine formation of thicker booklets consisting of 16 to 20 sheets)

In case 3, the booklet 50 consists of 16 to 20 standard sheets, and the spine 70 of the booklet 50 is formed by the third spine-forming face 63 with the projection amount L3. More specifically, referring to FIGS. 2B and 12, the controller 40 adjusts the rotational amount of the transport rollers 101 so that the booklet 50 is transported to the position where the leading edge portion 51 projects by the projection amount L3 from the leading edge faces 103*a*3 and 103*b*3 of the second pressing members 103*a* and 103*b*.From this state, as described above with reference to FIGS. 2A and 4, the load W is applied to the first pressing members 102, moving them in the respective pressing directions Y+, which causes the second pressing members 103 to slide in the sheet conveyance direction X. Then, as shown in FIG. 13, the leading edge portion 51 of the booklet 50 is pressed against the third spine-forming face 63. Then, the leading edge portion 51 is shaped into a spine 70 having a flat face whose width is set by a groove 63A including the third spine-forming face 63. Subsequently, as shown in FIG. 5, the transport pressure exerted by the transport rollers 101 is released, and then the booklet 50 is discharged as shown in FIGS. 6 and 7.

It is to be noted that the third spine-forming face 63 is positioned and the projection amount of the booklet 50 is adjusted directed by the CPU similarly to the descriptions above.

Thus, the spine 70 can be shaped suitably according to the thickness of the booklet 50.

It is to be noted that, although the above-described cases 1 through 3 concern forming the spine of booklets consisting of 1 to 20 sheets, the squire-spine device J may be configured to accommodate booklets consisting of a greater number of sheets. In such a case, the shapes, that is, the depths and widths, of the first, second, and third spine-forming faces 61, 62, and 63, are set according to the thickness of the booklets to be processed by the squire-spine device J. Similarly, the projection amount of the leading edge portion 51 is set according to the thickness of the booklets. Thus, the squire-spine device J can shape the spine of booklets of various thicknesses.

Descriptions are given below of procedure of the controller (CPU) 40 to direct the operations performed in the above-described cases 1 through 3 with reference to FIGS. 14 and 15.

Figure 14:
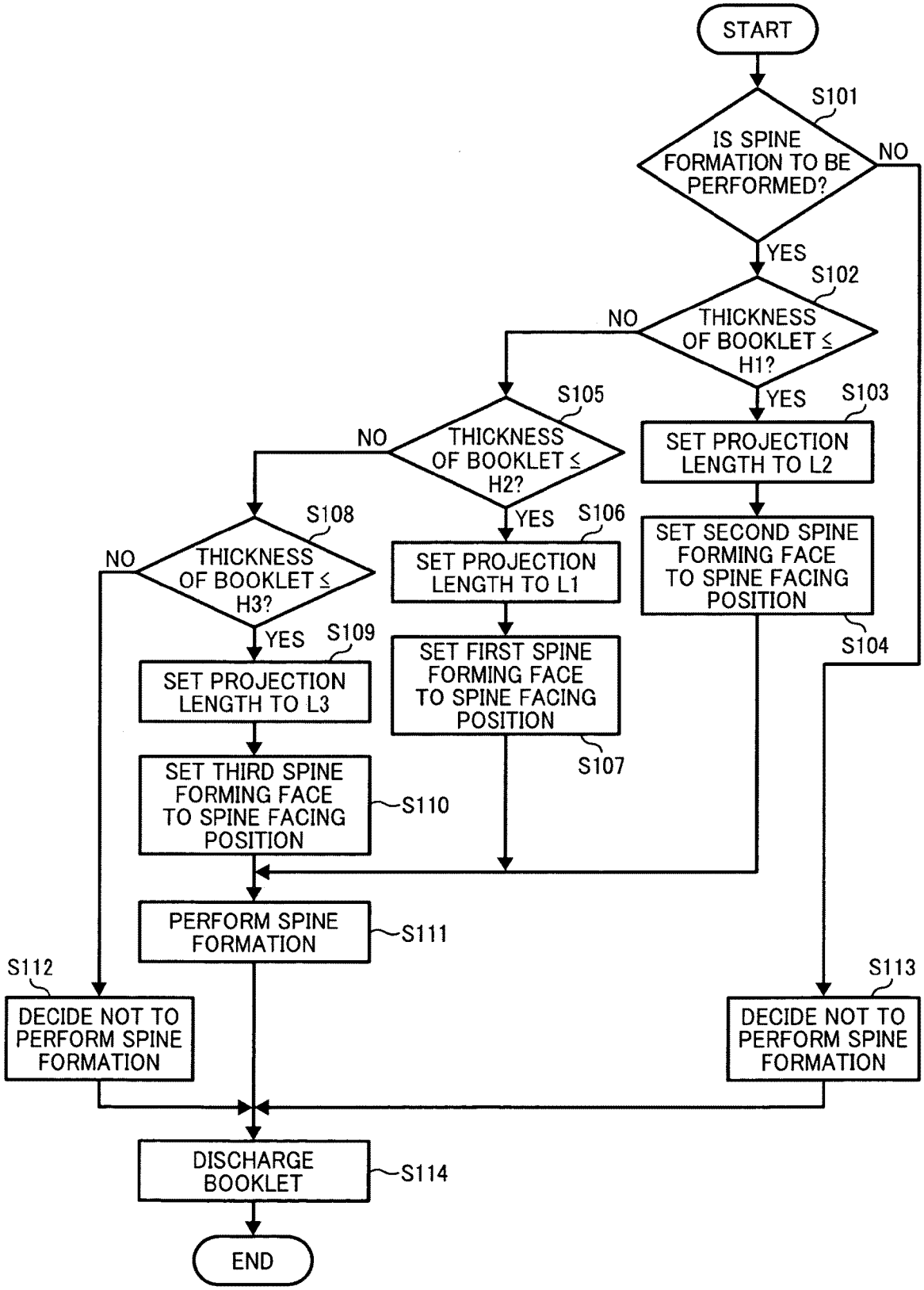
FIG. 14 is a flowchart illustrating a procedure of spine formation according to the thickness of a bundle of sheets.
Figure 15:
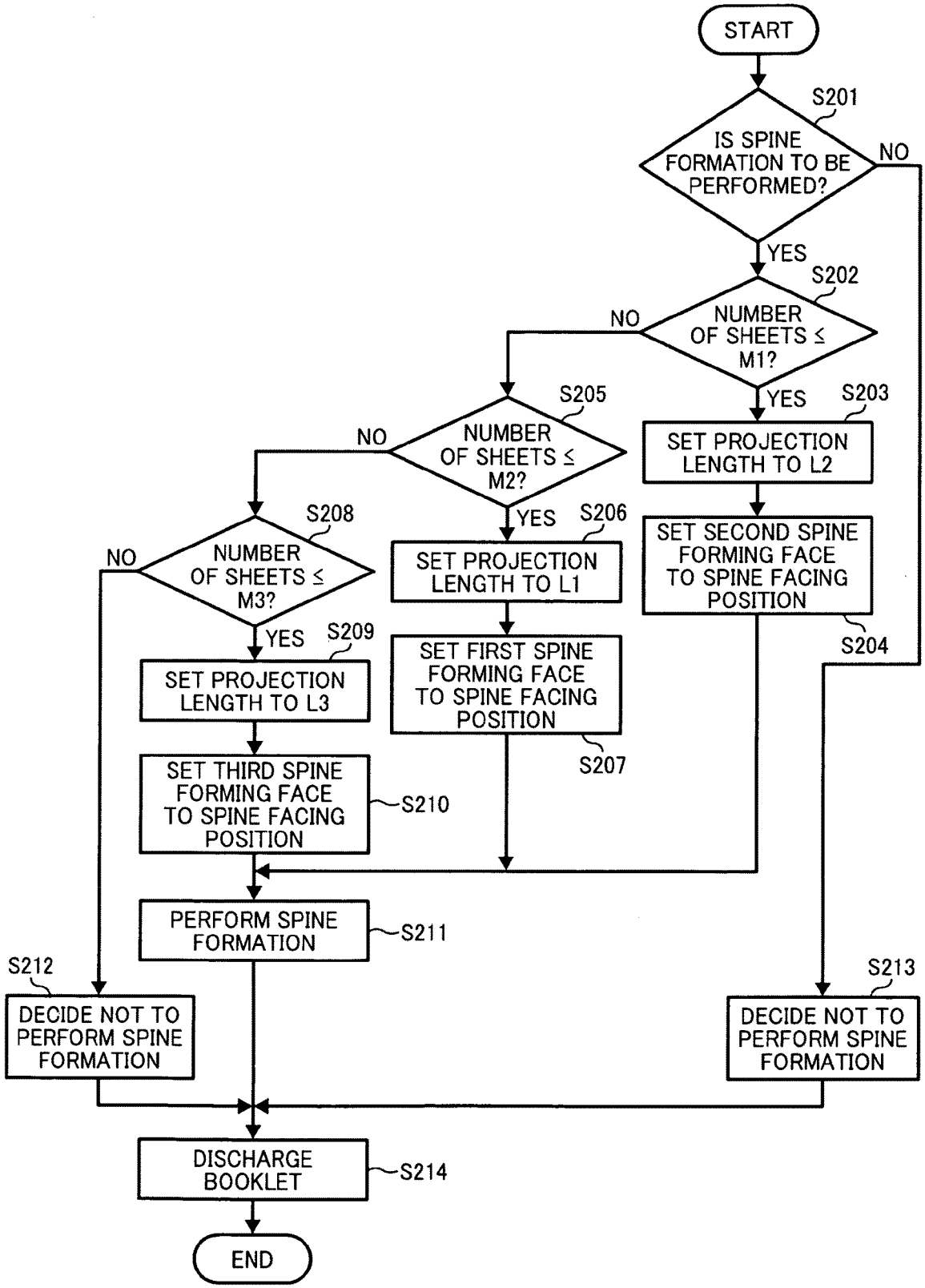
FIG. 15 is a flowchart illustrating a procedure of spine formation according to the number of sheets.

FIGS. 14 and 15 illustrates procedures of spine formation according to the thickness of booklets and according the number of sheets, respectively.

In the spine formation according to the thickness of booklets, as shown in FIG. 14, when the spine formation system shown in FIG. 1 starts center-folding and/or saddle-stapling, at S101, the controller 40 determines whether or not spine formation of folded sheets is to be performed. When spine formation is performed (Yes at S101), at S102, S105, and S108, the controller 40 checks the thickness of the sheets (booklet 50). More specifically, at S102, the controller 40 checks whether the thickness of the booklet 50 is within a first predetermined thickness H1 that in the present embodiment is 5 mm, for example. When the thickness is greater than 5 mm (No at S102), at S105 the controller 40 checks whether the thickness of the booklet 50 is within a second predetermined thickness H2 that in the present embodiment is 15 mm, for example. When the thickness is greater than 15 mm (No at S105), at S108 the controller 40 checks whether the thickness of the booklet 50 is within a third predetermined thickness H3 that in the present embodiment is 20 mm, for example.

When the thickness of the booklet 50 is within the first thickness H1 of 5 mm (Yes at S102), at S103 the booklet 50 is set at a position where the leading edge portion 51 projects by the projecting length L2 from the leading edge faces 103*a*3 and 103*b*3 of the second pressing members 103*a* and 103*b*. At S104, the fence 104 is moved so that the first spine-forming face 61 is set at a position facing the leading edge portion 51 (hereinafter "spine facing position").

When the thickness of the booklet 50 is within the second thickness H2 of 15 mm (Yes at S105), that is, within a range from 5 mm to 15 mm, at S106 the booklet 50 is set at a position where the leading edge portion 51 projects by the projecting length L1 from the leading edge faces 103*a*3 and 103*b*3 of the second pressing members 103*a* and 103*b*. At S107, the fence 104 is moved so that the second spine-forming face 62 is set at the spine facing position facing the leading edge portion 51.

When the thickness of the booklet 50 is within the third thickness H3 of 20 mm (Yes at S108), that is, within a range from 15 mm to 20 mm, at S109 the booklet 50 is set at a position where the leading edge portion 51 projects by the projecting length L3 from the leading edge faces 103*a*3 and

103*b*3 of the second pressing members 103*a* and 103*b*. At S110, the fence 104 is moved so that the third spine-forming face 63 is set at the spine facing position facing the leading edge portion 51.

After the suitable spine-forming face of the fence 104 is set at the spine facing position and the projection amount of the booklet 50 is set according to the thickness of the booklet 50, at S111, the load W is applied to the first pressing members 102, thereby causing the second pressing members 103 to slide in the sheet conveyance direction X, and the leading edge portion 51 of the booklet 50 is pressed against suitable one of the first, second, and third spine-forming faces 61, 62, and 63. After the spine formation, the booklet 50 is discharged at S114.

By contrast, when spine formation is not performed (No at S101) and when the thickness of the booklet 50 exceeds the third thickness H3 of 20 mm (No at S108), the controller 40 decides not to perform spine formation at S113 and at S112, respectively. It is to be noted that, for example, a CPU of a controller, not shown, of the image forming apparatus PR shown in FIG. 1 can transmit data on the sheets including sheet thickness and the number of sheets to be bound together, and the controller 40 (CPU) of the square-spine device J can compute a thickness H of the booklet (sheets) based on the sheet thickness and the number of sheets. The square spine-device J uses the computed thickness H in the above-described procedure. The above-described first, second, and third predetermined thicknesses H1, H2, and H3 (5 mm, 15 mm, and 20 mm) are only example, and the first, second, and third predetermined thicknesses H1, H2, and H3 can be set according to the spine-forming capacity of the square-spine device J.

As shown in FIG. 15, in the spine formation according to the number of sheets, operations performed in steps S201 through S214 are similar to those performed in steps S101 through S114 in the above-describe procedure shown in FIG. 14 except that steps S202, S205, and S208 are different from steps S102, S105, and S108 in FIG. 14.

More specifically, at S202, the controller 40 checks whether the number of the booklet 50 is within a first predetermined number M1 that in the present embodiment is five, for example. When the number of sheets is greater than five (No at S202), at S205 the controller 40 checks whether the number of sheets is within a second predetermined number M2 that in the present embodiment is 15, for example. When the number of sheets is greater than 15 (No at S205), at S208 the controller 40 checks whether the number of sheets is within a third predetermined thickness M3 that in the present embodiment is 20, for example. After the number of sheets is checked, in steps S203, S204, S206, S207, and S209 through S214, operations similar to the operations shown in FIG. 14 are performed, and thus the descriptions thereof are omitted.

It is to be noted that the first, second, and third predetermined number M1, M2, and M3 are set regarding standard sheets having a weight of 80 g/m$^2$ in the above-described procedure. A single thicker sheet having a weight of within a range from 100 g/m$^2$ to 128 g/m$^2$ is converted into two standard sheets, and a single thicker sheet having a weight exceeding 128 g/m$^2$ is converted into three standard sheets. The controller 40 (CPU) of the square-spine device J can compute the number of sheets constituting the booklet 50 based on the sheet thickness and the number of sheets transmitted from the image forming apparatus PR and then directs the procedure shown in FIG. 15. The above-described first, second, and third predetermined numbers M1 (5 sheets), M2 (15 sheets), and M3 (20 sheets) are only examples, and the first, second, and third predetermined number M1, M2, and M3 can be set according to the spine-forming capacity of the square-spine device J.

The first pressing members 102 and second pressing members 103 can be formed with a metal material or a plastic material. Metal is generally used as those pressing members due to its higher degrees of strength and durability, plastic may be used when the maximum set thickness of the spine is relatively small. In either case, although the second pressing members 103 exert pressure on the surfaces of the booklet 50, if frictional coefficient therebetween is smaller, the second pressing members 103 might slide on the surfaces of the booklet 50 when the leading edge portion 51 is being pressed against the fence 104. As a result, the booklet 50 may move back to the upstream side in the sheet conveyance direction X. If the booklet 50 move upstream in the sheet conveyance direction X, the pressure to press the leading edge portion 51 against the fence 40 is not sufficient for straightening it.

Therefore, in the present embodiment, a movement restrictor to prevent the booklet 50 from sliding to the upstream side is provided as described below with reference to FIGS. 16A through 17B.

Figure 16A:
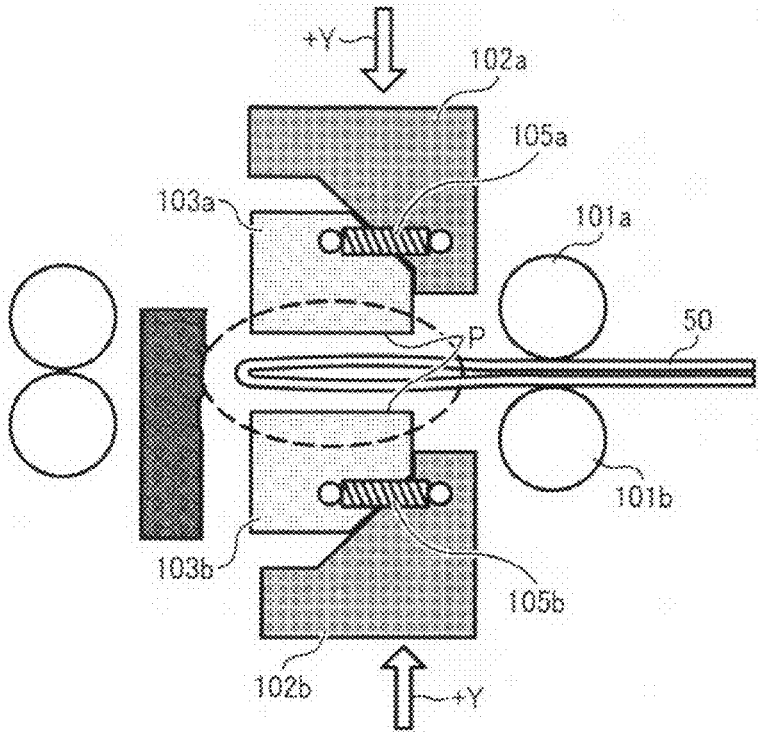
FIG. 16A illustrates pressure-contact surfaces of the second pressing members.
Figure 16B:
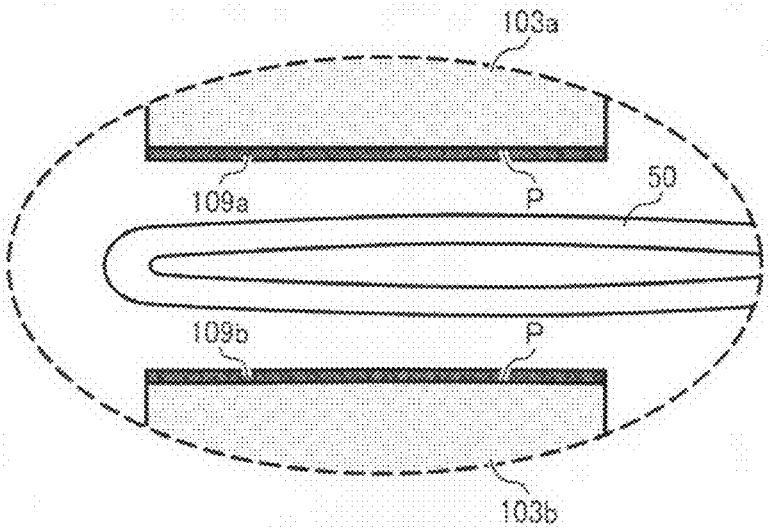
FIG. 16B is an enlarged view illustrating a configuration around the pressure-contact surfaces shown in FIG. 16A.

In FIG. 16, reference character P represents the surface of each second pressing member 103 that holds the booklet 50 with a certain degree of pressure (hereinafter "pressure-contact surface P"), and FIG. 16B is an enlarged view of a configuration around the pressure-contact surface P shown in FIG. 16A.

In the configuration shown in FIG. 16B, the movement restrictor is a rubber member 109 having a higher frictional coefficient, attached to the pressure-contact surface of each second pressing member 103 that contacts the booklet 50. Thus, the second pressing members 103*a* and 103*b* sandwich the booklet 50 therebetween via the rubber members 109*a* and 109*b*. Each rubber member 109 can be a rubber plate having a predetermined or given uniform thickness. In this configuration, the rubber members 109 serve as friction applicator to generate friction in the contact area between the second pressing members 103*a* and 103*b*, and friction can be generated entirely in the sheet conveyance direction X. Thus, sliding of the booklet 50 can be prevented or reduced.

To prevent sliding of the booklet 50, instead of increasing frictional force between the second pressing members 103 using the rubber members 109 shown in FIG. 16B, second pressing members 103*a*P and 103*b*P may respectively include projections 107*a* and 107*b* formed on the pressure-contact surfaces P. In this configuration, the projections 107 serve as intensive load applicator to localize the load to the projections 107*a* and 107*b*, and thus a pressure area in which the second pressing members 103*a*P and 103*b*P press the booklet 50 can be reduced, which enables the pressing members 103*a*P and 103*b*P to press the booklet 50 intensively. Consequently, the pressure can reach inside the booklet 50, thus preventing or inhibiting the booklet 50 from moving upstream in the sheet conveyance direction X.

Figure 17A:
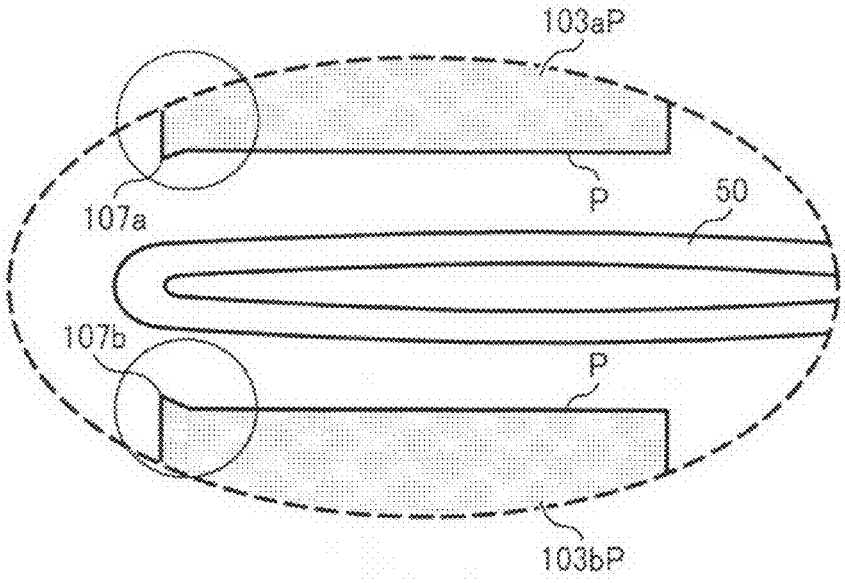
FIG. 17A illustrates a configuration in which a projection is formed on each pressure-contact surface shown in FIG. 16A.
Figure 17B:
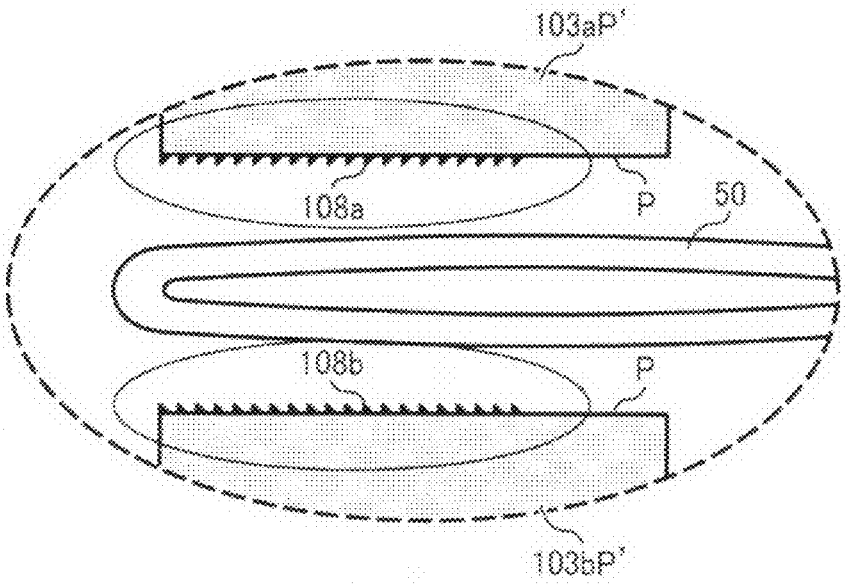
FIG. 17B illustrates a configuration in which multiple small projections are formed on each pressure-contact surface shown in FIG. 16A.

Alternatively, as shown in FIG. 17B, second pressing members 103*a*P' and 103*b*P' may include multiple small projections 108*a* and 108*b*, respectively, formed on the pressure-contact surfaces P. Each small projection 108 is positioned with its edge portion facing the sheet conveyance direction X. With this configuration, the booklet 50 can be pressed intensively, and edge portion of each small projection 108 facing the sheet conveyance direction X can inhibit the booklet 50 from moving upstream. Thus, this configuration can prevent the booklet 50 from moving upstream in the sheet conveyance direction X similarly.

Herein, in the configurations shown in FIGS. 16A through 17B in which frictional force is caused between the booklet 50 and the second pressing members 103, if frictional force between the contact surfaces 102*a*1 and 102*b*1 of the first pressing members 102*a* and 102*b* and the contact surfaces 103*a*1 and 103*b*1 of the second pressing members 103*a* and 103*b*, respectively, is relatively large, even when the load W is applied to the first pressing members 102 to move them in the respective pressing directions Y+, the second pressing members 130*a* and 130*b* fail to slide on the contact surfaces 102*a*1 and 102*b*1, respectively. As a result, it is possible that the booklet 50 cannot be pressed against the fence 104. Additionally, it is possible that the travel distance of the second pressing members 103 in the direction indicated by arrow +X is short relative to the size of the load W. That is, it is possible that an actual load W necessary to move the second pressing members 103 a required distance is larger than a set value.

Therefore, in the present embodiment, slide rails 1200*a* and 1200*b* are provided between the first pressing member 102*a* and the second pressing members 103*a* and the first pressing member 102*b* and the second pressing members 103*b*, respectively. The slide rails 1200*a* and 1200*b* serve as friction reducing mechanisms for reducing the friction between the first and second pressing members 102 and 103 while enabling the second pressing members 102 and 103 to move relative to each other slidingly.

Figure 18:
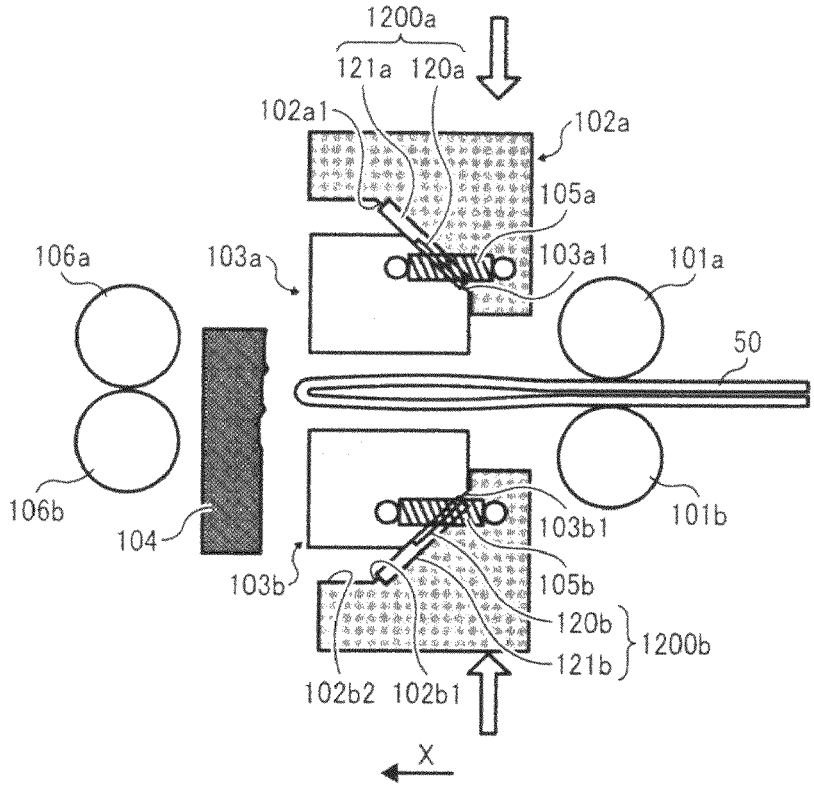
FIG. 18 illustrates an initial state in a configuration in which a slide rail is provided between the first pressing member and the second pressing member.
Figure 19:
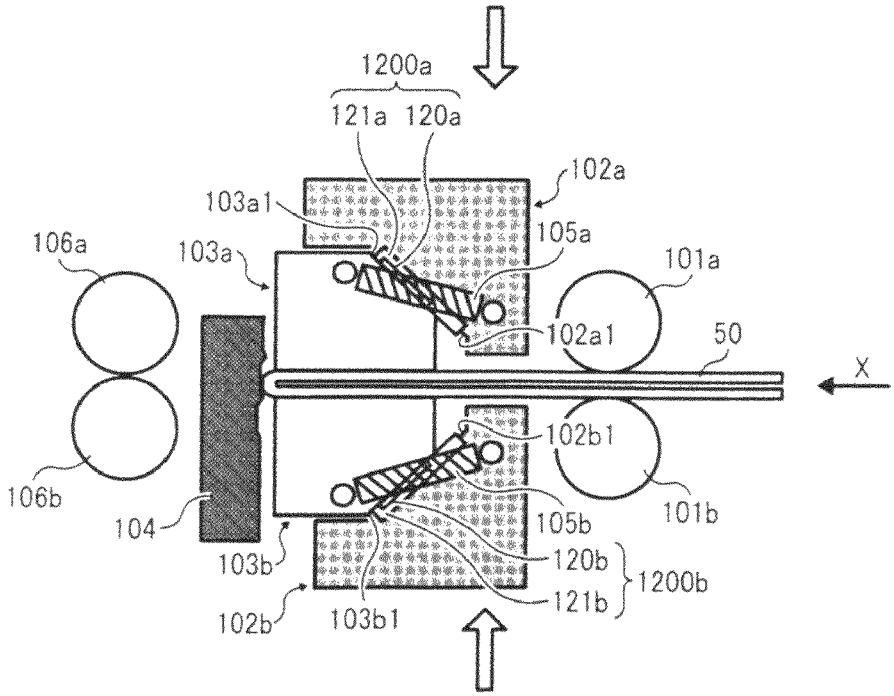
FIG. 19 illustrates the spine of sheets is being formed in the configuration including the slide rail shown in FIG. 18.

As shown in FIGS. 18 and 19, the slide rails 1200*a* and 1200*b* respectively include outer members 121*a* and 121*b* provided on the contact surfaces 102*a*1 and 102*b*1 of the first pressing members 102*a* and 120*b* and inner members 120*a* and 120*b* provided on the contact surfaces 103*a*1 and 103*b*1 of the second pressing members 103*a* and 103*b*. The inner members 120*a* and 120*b* slide on grooves of the outer members 121*a* and 121*b*, respectively. This configuration can reduce the friction between the first and second pressing members 102 and 103. When the first pressing members 102 move in the directions to approach each other as shown in FIG. 18, receiving the load W, the inner members 120*a* and 120*b* move along the outer members 121*a* and 121*b*, respectively, and thus the second pressing members 103*a* and 103*b* can move in the direction indicated by arrow X with a relatively low frictional force. As a result, the leading edge portion 51 of the booklet 50 can be shaped into the flat spine 70 reliably.

Figure 20:
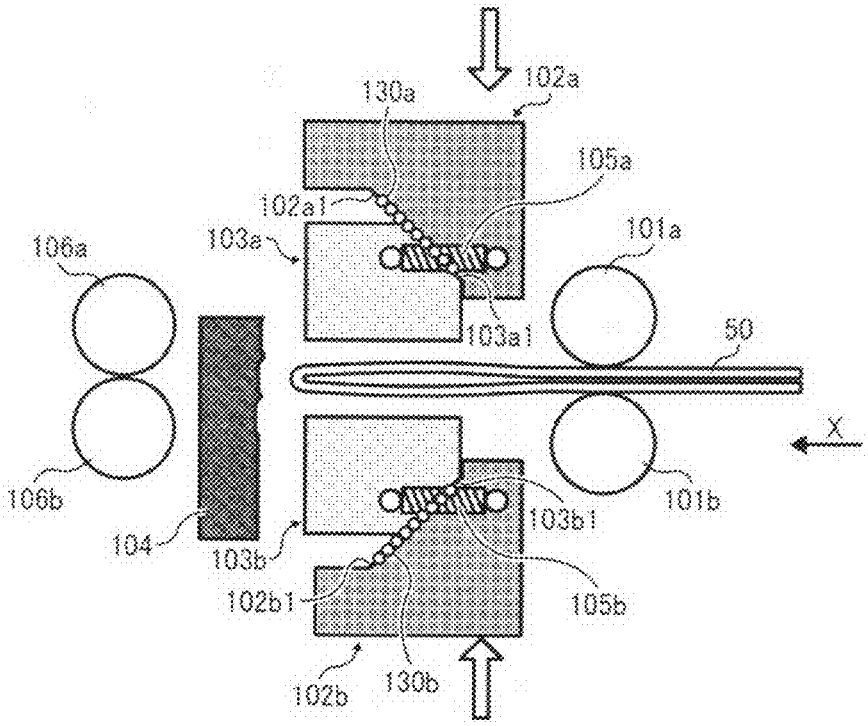
FIG. 20 illustrates an initial state in a configuration in which a ball bearing is provided between the first pressing member and the second pressing member.
Figure 21:
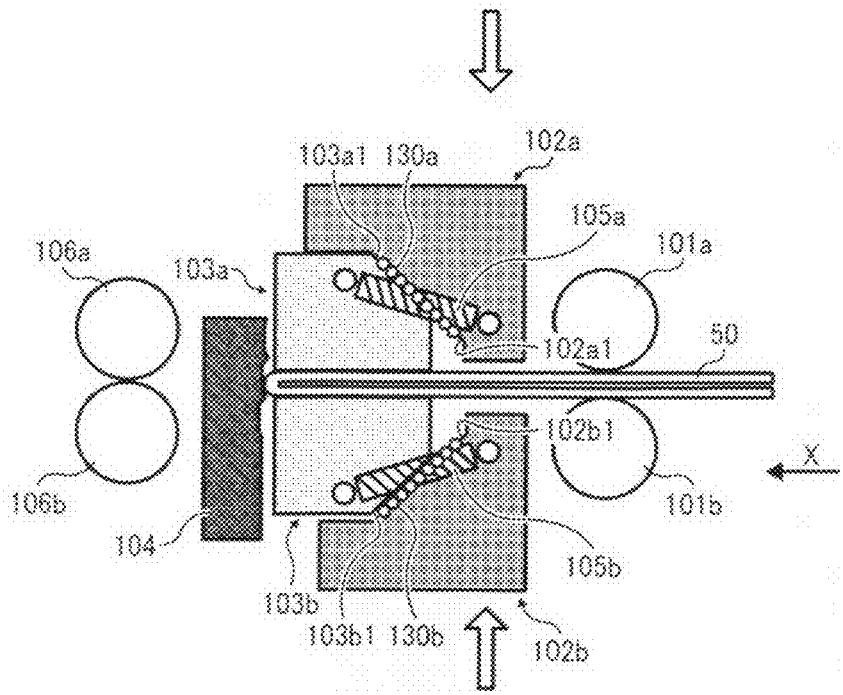
FIG. 21 illustrates the spine of sheets is being formed in the configuration including the ball bearing shown in FIG. 20.

Alternatively, instead of the slide rails 1200*a* and 1200*b* shown in FIGS. 18 and 19, ball bearings 130*a* and 130*b* can be used so that the first pressing members 102 and the second pressing members 103 contact via multiple balls, respectively. FIGS. 20 and 21 illustrate the configuration in which the ball bearings 130*a* and 130*b* are used to reduce the frictional force between the contact surfaces 102*a*1 and 102*b*1 and the contact surfaces 103*a*1 and 103*b*1, respectively.

More specifically, in this configuration, as shown in FIG. 20, ball bearings 103*a* and 130*b* are provided between the contact surfaces 102*a*1 and 102*b*1 of the first pressing member 102*a* and 102*b* and the contact surfaces 103*a*1 and 103*b*1 of the second pressing members 103*a* and 103*b*, and thus the respective balls of the ball bearings 130*a* and 130*b* can receive the force between the first pressing members 102*a* and 102*b* and the second pressing members 103*a* and 103*b*.With this configuration, when the first pressing members 102 move in the directions to approach each other, receiving the load W, the respective balls of the ball bearings 130*a* and 130*b* rotate, and thus the second pressing members 103*a* and 103*b* can move in the direction indicated by arrow X with a relatively low frictional force. As a result, the leading edge portion 51 of the booklet 50 can be shaped into the flat spine 70 reliably. Thus, the ball bearings 1200*a* and 1200*b* serve as friction reducing mechanisms for reducing the friction between the first and second pressing members 102 and 103 while enabling the second pressing members 102 and 103 to move relative to each other slidingly.

It is to be noted that, instead of the configurations described above with reference to FIGS. 18 through 21, the contact surfaces 102*a*1, 102*b*1, 103*a*1, and 103*b*1 may be coated with silicone resin material having a lower frictional coefficient to reduce the frictional force. Alternatively, small rollers may be provided on an edge portion of each inner member 120.

In either configuration, failure in forming the spine due to insufficient pressure can be prevented or reduced by reducing the frictional force between the contact surfaces 102*a*1 and 102*b*1 and the contact surfaces 103*a*1 and 103*b*1 so that the second pressing member 103*a* and 103*b* can move under a relatively low resistivity.

It is to be noted that, although the square-spine device J is positioned in a stage subsequent to the post-processing apparatus 1 (saddle-stitching bookbinding device) and configured to form spines of folio sheets (booklet 50) that are either stapled or folded along its centerline in the descriptions above, an edge-cutting device may be provided in a stage subsequent to the square-spine device J so that the edge of the booklet 50 that is opposite the folded side can be cut. Such edge-cutting devices are described in laid-open Japanese Patent Application Nos. 2005-263404 and 2008-290847, for example, and thus descriptions thereof are omitted.

Therefore, the image forming apparatus PR, the post-processing apparatus 1, and the square-spine device J may be integrated into a system as in the present embodiment, and the system may further include an edge-cutting device in addition to those devices. In either case, the spine formation system is concomitant to the image forming apparatus PR in the present embodiment.

As described above, the present embodiment can attain the following effects:

1) Corners of the leading edge portions 51 of the booklet 50 can be reliably angled because the leading edge portions 51 can be pressed against the fence 104 with a predetermined force (load) securely while the folded (curved) leading edge portions 51 is sandwiched by the second pressing members 103.

2) At that time, the leading edge portion 51 of the booklet 50 projecting from the second pressing members 103 sandwiching the booklet 50 therebetween is pressed against the flat fence 104, and thus bulging of the spine 70 formed by the fence 104 can be reduced.

3) The multiples grooves 61A, 62A, and 63A respectively including spine-forming faces 61, 62, and 63 whose depths and widths are different to accommodate the booklets 50 of different thicknesses are formed in the fence 104, and thus the spine 70 can be shaped to have a width suitable for the thickness of the booklet 50.

4) Because the projection amount of the leading edge portion 51 from the leading edge faces 103*a*3 and 103*b*3 of the second pressing members 103*a* and 103*b* is changed according to the thickness of the booklet 50, a space required for spine formation can be optimized, thereby releasing the force of the booklet 50 to deform. As a result, forming the flat spine 70 can be facilitated.

5) Because flatness of the spine is improved, back face of the booklet 50 can be good.

6) The angle (inclination) θ of the oblique contact surfaces, 102*a*1, 102*b*1, 103*a*1, and 103*b*2 of the first and second pressing members 102 and 103 to the sheet transport direction is set so that the force to hold the booklet 50 (component of force Fp) is greater than the force acting in the sheet conveyance direction X (component of force Fh). Consequently, the booklet 50 can be held securely. This configuration can prevent the booklet 50 from moving to the upstream side in the sheet conveyance direction X, and accordingly a sufficient load for forming the spine can be applied to the leading edge portion 51 of the booklet 50.

7) To prevent the booklet 50 from moving to the upstream side in the sheet conveyance direction X, the rubber member 109 is provided to the pressure-contact surface P of each second pressing members 103 so that the booklet 50 is sandwiched via the rubber members 109, the projection 107 is formed on each pressure-contact surface P so that the load is localized to the projection 107, the multiple small projections 108 are formed on each pressure-contact surfaces P so that the pressure to the booklet 50 can be localized. As a result, a load sufficient for forming the spine can be applied to the leading edge portion 51 of the booklet 50.

8) To reduce the frictional force between the oblique contact surfaces 102*a*1 and 102*b*1 of the first pressing members 102*a* and 102*b* and the oblique contact surfaces 103*a*1 and 103*b*1 of the second pressing members 103*a* and 103*b*, the slide rails 1200 each including the outer member 121 and inner member 120 or the ball bearings 130 are provided between the contact surfaces 102*a*1 and 102*b*1 and the contact surfaces 103*a*1 and 103*b*1, respectively. Therefore, the spine forming load can be relatively small. Numerous additional modifications and variations are possible in light of the above teachings. It is therefore to be understood that, within the scope of the appended claims, the disclosure of this patent specification may be practiced otherwise than as specifically described herein.

What is claimed is:

1. A spine formation device comprising:

a sheet conveyer that conveys a bundle of folded sheets with a folded portion of the bundle of folded sheets forming a front end portion of the bundle of folded sheets;

a pressing unit disposed downstream from the sheet conveyer in a sheet conveyance direction in which the sheet conveyer conveys the bundle of folded sheets, the pressing unit including a first pressing member movable according to a pressing load applied thereto in a pressing direction perpendicular to the sheet conveyance direction to press opposed sides of the front end portion of the bundle of folded sheets conveyed with the sheet conveyer, and a second pressing member attached to the first pressing member and disposed closer to the bundle of folded sheets than the first pressing member, to press the front end portion of the bundle of folded sheets, the second pressing member movable in the sheet conveyance direction in conjunction with movement of the first pressing member; and a spine formation member disposed downstream from the pressing unit in the sheet conveyance direction at a predetermined distance from the pressing unit, the spine formation member including a contact surface against which the folded portion of the bundle of folded sheets is pressed with a predetermined spine-forming load to form a spine of the bundle of folded sheets with the second pressing member in conjunction with the first pressing member moving in the pressing direction wherein each of the first pressing member and the second pressing member comprises an oblique contact surface oblique to the pressing direction of the first pressing member, and the first pressing member and the second pressing member are in sliding contact with each other at the oblique contact surface of the first pressing member.

2. The spine formation device according to claim 1, wherein an angle of each of the oblique contact surfaces of the first pressing member and the second pressing member to the sheet conveyance direction is 45 degrees or smaller, providing a force to press the bundle of folded sheets greater than the predetermined spine-forming load to press the folded portion of the bundle of folded sheets against the contact surface of the spine formation member.

3. The spine formation device according to claim 1, further comprising a friction reducing mechanism to reduce a frictional force between the first pressing member and the second pressing member while maintaining sliding contact between the first pressing member and the second pressing member.

4. The spine formation device according to claim 3, wherein the friction reducing mechanism comprises:

a first slide member attached to the oblique contact surface of the first pressing member; and a second slide member attached to the oblique contact surface of the second pressing member and slidingly engaging the first slide member.

5. The spine formation device according to claim 3, wherein the friction reducing mechanism comprises a ball bearing provided between the oblique contact surface of the first pressing member and the oblique contact surface of the second pressing member.

6. The spine formation device according to claim 1, further comprising an elastic bias applicator to elastically bias the second pressing member toward the first pressing member in a direction parallel to a direction in which the second pressing member moves as the first pressing member moves in the pressing direction.

7. The spine formation device according to claim 6, wherein the elastic bias applicator keeps the second pressing member closest to the first pressing member while the second pressing member is on standby.

8. The spine formation device according to claim 1, further comprising a movement restrictor to prevent the bundle of folded sheets from moving away from the spine formation member when the predetermined spine-forming load is applied to the folded portion of the bundle of folded sheets being pressed against the spine formation member, wherein the second pressing member comprises a first part and a second part each including a pressure-contact surface to press against the bundle of folded sheets, disposed facing each other across the bundle of folded sheets, and the movement restrictor is disposed between the pressure-contact surface of the first part and the pressure-contact surface of the second part.

9. The spine formation device according to claim 8, wherein the movement restrictor comprises a friction applicator provided between the pressure-contact surface of the first part and the pressure-contact surface of the second part.

10. The spine formation device according to claim 8, wherein the movement restrictor comprises a projection formed on the pressure-contact surface of each of the first part and the second part of the second pressing member, wherein the projection formed on the pressure-contact surface localizes the pressing load applied via the first pressing member against the bundle of folded sheets.

11. The spine formation device according to claim 1, wherein the spine formation device has an input representing a thickness of the bundle and varies an amount by which the folded portion of the bundle of folded sheets projects from a surface of the second pressing member facing the spine formation member according to a thickness of the bundle of folded sheets.

12. The spine formation device according to claim 1, wherein the spine formation device has an input representing a thickness of the bundle and varies an amount by which the folded portion of the bundle of folded sheets projects from a surface of the second pressing member facing the spine formation member according to the number of the folded sheets.

13. The spine formation device according to claim 1, wherein the spine formation member comprises multiple grooves of different widths formed in the contact surface, and each groove width corresponds to a predetermined thickness of the bundle of folded sheets or a predetermined number of sheets.

14. The spine formation device according to claim 13, further comprising a driving unit to move the spine formation member in a direction perpendicular to the sheet conveyance direction, wherein the driving unit moves the spine formation member to position one of the multiple grooves formed in the contact surface of the spine formation member facing the folded portion of the bundle of folded sheets, and the groove thus positioned matches the thickness of the bundle of folded sheets or the number of the folded sheets.

15. The spine formation device according to claim 1, further comprising a driving unit to move the spine formation member in a direction perpendicular to the sheet conveyance direction.

16. The spine formation device according to claim 15, wherein the driving unit moves the spine formation member away from a sheet conveyance path after the second pressing member presses the folded portion of the bundle of folded sheets against the spine formation member to form the spine and then moves away from the bundle of folded sheets.

17. A post-processing apparatus comprising:

a saddle-stapler to staple a bundle of sheets together along a centerline;

a folding unit to fold the bundle of sheets; and a spine formation device to flatten the folded portion of the bundle of sheets, the spine formation device comprising:

a sheet conveyer that conveys a bundle of folded sheets with a folded, portion of the bundle of folded sheets forming a front end portion of the bundle of folded sheets;

a pressing unit disposed downstream from the sheet conveyer in a sheet conveyance direction in which the sheet conveyer conveys the bundle of folded sheets, the pressing unit including a first pressing member movable according to a pressing load applied thereto in a pressing direction perpendicular to the sheet conveyance direction to press opposed sides of the front end portion of the bundle of folded sheets conveyed with the sheet conveyer, and a second pressing member attached to the first pressing member and disposed closer to the bundle of folded sheets than the first pressing member, to press the front end portion of the bundle of folded sheets, the second pressing member movable in the sheet conveyance direction in conjunction with movement of the first pressing member; and a spine formation member disposed downstream from the pressing unit in the sheet conveyance direction at a predetermined distance from the pressing unit, the spine formation member including a contact surface against which the folded portion of the bundle of folded sheets is pressed with a predetermined spine-forming load to form a spine of the bundle with the second pressing member in conjunction with the first pressing member moving in the pressing direction wherein each of the first pressing member and the second pressing member comprises an oblique contact surface oblique to the pressing direction of the first pressing member, and the first pressing member and the second pressing member are in sliding contact with each other at the oblique contact surface of the first pressing member.

18. A spine formation system comprising:

an image forming apparatus;

a post-processing apparatus to perform post processing of sheets transported from the image forming apparatus; and a spine formation device to flatten a folded portion of a bundle of sheets, the spine formation device comprising:

a sheet conveyer that conveys a bundle of folded sheets with a folded portion of the bundle of folded sheets forming a front end portion of the bundle of folded sheets;

a pressing unit disposed downstream from the sheet conveyer in a sheet conveyance direction in which the sheet conveyer conveys the bundle of folded sheets, the pressing unit including a first pressing member movable according to a pressing load applied thereto in a pressing direction perpendicular to the sheet conveyance direction to press opposed sides of the front end portion of the bundle of folded sheets conveyed with the sheet conveyer, and a second pressing member attached to the first pressing member and disposed closer to the bundle of folded sheets than the first pressing member, to press the front end portion of the bundle of folded sheets, the second pressing member movable in the sheet conveyance direction in conjunction with movement of the first pressing member; and a spine formation member disposed downstream from the pressing unit in the sheet conveyance direction at a predetermined distance from the pressing unit, the spine formation member including a contact surface against which the folded portion of the bundle of folded sheets is pressed with a predetermined spine-forming load to form a spine of the bundle with the second pressing member in conjunction with the first pressing member moving in the pressing direction wherein each of the first pressing member and the second pressing member comprises an oblique contact surface oblique to the pressing direction of the first pressing member, and the first pressing member and the second pressing member are in sliding contact with each other at the oblique contact surface of the first pressing member.

* * * * *